US011735349B2

(12) United States Patent
Sturcken et al.

(10) Patent No.: US 11,735,349 B2
(45) Date of Patent: Aug. 22, 2023

(54) MAGNETIC CORE WITH VERTICAL LAMINATIONS HAVING HIGH ASPECT RATIO

(71) Applicant: Ferric Inc., New York, NY (US)

(72) Inventors: Noah Sturcken, New York, NY (US); Denis Shishkov, Brooklyn, NY (US); Matthew Cavallaro, New York, NY (US); Michael Lekas, Brooklyn, NY (US); Ryan Davies, New York, NY (US)

(73) Assignee: Ferric Inc., New York, NY (US)

( * ) Notice: Subject to any disclaimer, the term of this patent is extended or adjusted under 35 U.S.C. 154(b) by 892 days.

(21) Appl. No.: 16/557,476

(22) Filed: Aug. 30, 2019

(65) Prior Publication Data

US 2021/0065959 A1 Mar. 4, 2021

(51) Int. Cl.

| | |
|---|---|
| ***H01F 41/02*** | (2006.01) |
| ***H01F 27/24*** | (2006.01) |
| ***H01F 27/25*** | (2006.01) |
| *H01F 41/18* | (2006.01) |

(52) U.S. Cl.

CPC ..... *H01F 27/24* (2013.01); *H01F 27/25* (2013.01); *H01F 41/0213* (2013.01); *H01F 41/18* (2013.01)

(58) Field of Classification Search

CPC ..... H01F 27/24; H01F 41/0213; H01F 41/18

See application file for complete search history.

(56) References Cited

U.S. PATENT DOCUMENTS

| | | | |
|---|---|---|---|
| 3,868,561 | A | 2/1975 | Matthes |
| 5,757,056 | A | 5/1998 | Chui |
| 6,110,609 | A | 8/2000 | Hiramoto et al. |
| 2009/0188104 | A1 | 7/2009 | Ching et al. |
| 2010/0270644 | A1 | 10/2010 | Dellis et al. |
| 2013/0062729 | A1 | 3/2013 | Hopper et al. |
| 2013/0285256 | A1 | 10/2013 | Fischer et al. |
| 2013/0288391 | A1 | 10/2013 | Lee et al. |
| 2014/0159196 | A1 | 6/2014 | Mackh et al. |
| 2015/0348695 | A1 | 12/2015 | Kostelnik et al. |
| 2017/0178781 | A1 | 6/2017 | O'Donnell et al. |
| 2018/0182841 | A1* | 6/2018 | Sturcken ..... H01L 21/2885 |

(Continued)

OTHER PUBLICATIONS

Shen et al. (Shen et al., "A Clamped Through Silicon Via (TSL) Interconnection for Stacked Chip Bonding Using Metal Cap on Pad and Metal Column Forming in Via", Electronic Components and Technology Conference; pp. 544-549 (Year: 2008).*

(Continued)

*Primary Examiner* — Binh X Tran
(74) *Attorney, Agent, or Firm* — Intrinsic Law Corp.

(57) ABSTRACT

A method for manufacturing a vertically-laminated ferromagnetic core includes (a) depositing a conductive seed layer on or over a first side of a substrate; (b) depositing a masking layer on or over a second side of the substrate, the first and second sides on opposite sides of the substrate; (c) forming a pattern in the masking layer; (d) dry etching the substrate, based on the pattern in the masking layer, from the second side to the first side to expose portions of the conductive seed layer; and (e) depositing a ferromagnetic material onto the exposed portions of the conductive seed layer to form vertically-oriented ferromagnetic layers.

27 Claims, 21 Drawing Sheets

(56) References Cited

U.S. PATENT DOCUMENTS

2018/0302986 A1 10/2018 Sturcken et al.

OTHER PUBLICATIONS

Shen, L et al. "A Clamped Through Silicon Via (TSV) Interconnection for Stacked Chip Bonding Using Metal Cap on Pad and Metal col. Forming in VIA", 2008 58th Electronic Components and Technology Conference; May 27-30, 2008, p. 544-549.

ISA, "International Search Report", PCT/US2019/049153, dated Feb. 5, 2020.

D. P. Arnold et al., "Vertically Laminated Magnetic Cores by Electroplating Ni—Fe Into Micromachined Si", IEEE Transactions on Magnetics, Jul. 2004, p. 3060-3062, vol. 40, No. 4, IEEE.

N. Sturcken et al., "Design of Coupled Power Inductors with Crossed Anisotropy Magnetic Core for Integrated Power Conversion", Columbia University.

D. W. Lee et al., "Design and Fabrication of Integrated Solenoid Inductors with Magnetic Cores", Electronic Components and Technology Conference, 2008, p. 701-705, IEEE.

N. Sturcken et al., "A 2.5D Integrated Voltage Regulator Using Coupled-Magnetic-Core Inductors on Silicon Interposer Delivering 10.8A/mm(2)", Advances in Heterogeneous Integration, 2012, p. 3-5, Session 23.1, IEEE International Solid-State Circuits Conference, IEEE.

N. A. Sturcken, "Integrated Voltage Regulators with Thin-Film Magnetic Power Inductors", 2013, Columbia University.

TIPO, "Notification of Office Action", 109102469, dated Jan. 8, 2021.

* cited by examiner

MAGNETIC CORE WITH VERTICAL LAMINATIONS HAVING HIGH ASPECT RATIO

TECHNICAL FIELD

This application relates generally to magnetic cores and devices that include magnetic cores such as inductors.

BACKGROUND

The increase in computing power, spatial densities in semiconductor-based devices and energy efficiency of the same allow for ever more efficient and small microelectronic sensors, processors and other machines. These have found wide use in mobile and wireless applications and other industrial, military, medical and consumer products.

Even though computing energy efficiency is improving over time, the total amount of energy used by computers of all types is on the rise. Hence, there is a need for even greater energy efficiency. Most efforts to improve the energy efficiency of microelectronic devices has been at the chip and transistor level, including with respect to transistor gate width. However, these methods are limited, and other approaches are necessary to increase device density and processing power and to reduce power consumption and heat generation.

One field that can benefit from the above improvements is in switched inductor power conversion devices. These devices can be challenging because power loss increases with higher currents, pursuant to Ohm's law: $P_{loss}=I^2R$, where $P_{loss}$ is the power loss over the length of wire and circuit trace, I is the current and R is the inherent resistance over the length of wire and circuit trace. As such, and to increase overall performance, there has been a recognized need in the art for large scale integration of compact and dense electrical components at the chip level, such as for use with the fabrication of complementary metal oxide semiconductors (CMOS).

With the development of highly integrated electronic systems that consume large amounts of electricity in very small areas, the need arises for new technologies which enable improved energy efficiency and power management for future integrated systems. Integrated power conversion is a promising potential solution as power can be delivered to integrated circuits at higher voltage levels and lower current levels. That is, integrated power conversion allows for step-down voltage converters to be disposed in close proximity to transistor elements.

Unfortunately, practical integrated inductors that are capable of efficiently carrying large current levels for switched-inductor power conversion are not available. Specifically, inductors that are characterized by high inductance (e.g., greater than 1 nH), low resistance (e.g., less than 1 ohm), high maximum current rating (e.g., greater than 100 mA), and high frequency response whereby there is little or no inductance decrease for alternating current (AC) input signal up to 10 MHz are unavailable or impractical using present technologies.

Furthermore, all of these properties must be economically achieved in a small area, typically less than 1 $mm^2$, a form required for CMOS integration either monolithically or by 3D or 2.5D chip stacking. Thus, an inductor with the aforementioned properties is necessary in order to implement integrated power conversion with high energy efficiency and low inductor current ripple which engenders periodic noise in the output voltage of the converter, termed output voltage ripple.

Accordingly, there is a need for high quality inductors to be used in large scale CMOS integration, to provide a platform for the advancement of systems comprising highly granular dynamic voltage and frequency scaling as well as augmented energy efficiency.

The use of high permeability, low coercivity material is typically required to achieve the desired inductor properties on a small scale. In electromagnetism, permeability is the measure of the ability of a material to support the formation of a magnetic field within itself. In other words, it is the degree of magnetization that a material obtains in response to an applied magnetic field. A high permeability denotes a material achieving a high level of magnetization for a small applied magnetic field.

Coercivity, also called the coercive field or force, is a measure of a ferromagnetic or ferroelectric material's ability to withstand an external magnetic or electric field, respectively. Coercivity is the measure of hysteresis observed in the relationship between applied magnetic field and magnetization. The coercivity is defined as the applied magnetic field strength necessary to reduce the magnetization to zero after the magnetization of the sample has reached saturation. Thus coercivity measures the resistance of a ferromagnetic material to becoming demagnetized. Ferromagnetic materials with high coercivity are called magnetically hard materials and are used to make permanent magnets. Ferromagnetic materials that exhibit a high permeability and low coercivity are called magnetically soft materials and are often used to enhance the inductance of inductors.

Coercivity is determined by measuring the width of the hysteresis loop observed in the relationship between applied magnetic field and magnetization. Hysteresis is the dependence of a system not only on its current environment but also on its past environment. This dependence arises because the system can be in more than one internal state. When an external magnetic field is applied to a ferromagnet such as iron, the atomic dipoles align themselves with it. Even when the field is removed, part of the alignment will be retained: the material has become magnetized. Once magnetized, the magnet will stay magnetized indefinitely. To demagnetize it requires heat or a magnetic field in the opposite direction.

High quality inductors are typically made from high permeability, low coercivity material. However, high permeability materials tend to saturate when biased by a large direct current (DC) magnetic field. Magnetic saturation can have adverse effects as it results in reduced permeability and consequently reduced inductance.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

An aspect of the invention is directed to a method for manufacturing a vertically-laminated ferromagnetic core, comprising: depositing a conductive seed layer on or over a first side of a substrate; depositing a masking layer on or over a second side of the substrate, the first and second sides on opposite sides of the substrate; forming a pattern in the masking layer; dry etching the substrate, based on the pattern in the masking layer, from the second side to the first side to expose portions of the conductive seed layer; and depositing a ferromagnetic material onto the exposed portions of the conductive seed layer to form vertically-oriented ferromagnetic layers.

In one or more embodiments, the substrate comprises a bare silicon substrate or a silicon-on-insulator (SOI) substrate, the SOI substrate comprising a layer of $SiO_2$ and/or $Si_xN_y$ on the bare silicon substrate. In one or more embodiments, etching the substrate includes deep reactive ion etching the substrate. In one or more embodiments, the masking layer comprises a photoresist. In one or more embodiments, the pattern in the masking layer is formed through photolithography.

In one or more embodiments, the masking layer comprises $SiO_2$ or $Si_xN_y$ and the method further comprises depositing photoresist on the masking layer. In one or more embodiments, the method further comprises forming a first pattern in the photoresist through photolithography. In one or more embodiments, the method further comprises etching a second pattern in the masking layer based on the first pattern. In one or more embodiments, the method further comprises etching the substrate based on the second pattern in the masking layer.

In one or more embodiments, each vertically-oriented ferromagnetic layer has a width of about 5 nm to about 50 μm, the width determined with respect to a width axis that is parallel to a plane defined by the first side of the substrate. In one or more embodiments, each vertically-oriented ferromagnetic layer has a height of about 100 μm to about 800 μm, the height determined with respect to a height axis that is orthogonal to the plane defined by the first side of the substrate. In one or more embodiments, the height of each vertically-oriented ferromagnetic layer is the same as a height of the substrate.

In one or more embodiments, the method further comprises electrodepositing the ferromagnetic material. In one or more embodiments, the method further comprises applying a magnetic field during the electrodepositing step, the magnetic field passing through the substrate in parallel to a reference axis, the reference axis orthogonal to a plane defined by the first side of the substrate. In one or more embodiments, the method further comprises inducing an easy axis of magnetization in the ferromagnetic material, the easy axis of magnetization parallel to the reference axis. In one or more embodiments, the method further comprises inducing a hard axis of magnetization in the ferromagnetic material, the hard axis of magnetization orthogonal to the easy axis of magnetization.

In one or more embodiments, the method further comprises removing the masking layer with a solvent, a wet etch, or a dry etch. In one or more embodiments, the method further comprises removing the conductive seed layer with a wet etch or a dry etch. In one or more embodiments, the method further comprises depositing a passivation layer on the first and second sides of the substrate. In one or more embodiments, the pattern in the masking layer comprises concentric circles, the ferromagnetic material deposited on the portions of the conductive seed layer according to the pattern.

Another aspect of the invention is directed to a method for manufacturing an inductor having a vertically-laminated ferromagnetic core, comprising: depositing a conductive seed layer on or over a first side of a substrate; depositing a masking layer on or over a second side of the substrate, the first and second sides on opposite sides of the substrate; forming a pattern in the masking layer; dry etching the substrate, based on the pattern in the masking layer, from the second side to the first side to expose portions of the conductive seed layer; depositing a ferromagnetic material onto the exposed portions of the conductive seed layer to form vertically-oriented ferromagnetic layers to thereby form the vertically-laminated ferromagnetic core; removing the conductive seed layer to expose the first side of the substrate; removing the masking layer to expose the second side of the substrate; and forming a conductive coil around the vertically-laminated ferromagnetic core.

In one or more embodiments, the method further comprises, after removing the conductive seed layer and the masking layer, depositing first and second passivation layers on the first and second sides of the substrate, respectively. In one or more embodiments, the method further comprises forming first and second wire segments in the first and second passivation layers, respectively. In one or more embodiments, the method further comprises forming first and second VIAs in the substrate, each VIA electrically coupling the first and second wire segments.

In one or more embodiments, the substrate is a core substrate and the method further comprises, after removing the conductive seed layer and the masking layer, attaching first and second substrates to the first and second sides of the core substrate, respectively.

In one or more embodiments, the method further comprises forming first and second wire segments in the first and second substrates, respectively. In one or more embodiments, the method further comprises forming first and second VIAs in the core substrate, each VIA electrically coupling the first and second wire segments.

Yet another aspect of the invention is directed to a vertically-laminated ferromagnetic core comprising: a substrate having opposing first and second sides, the substrate comprising patterned voids that extend from the first side to the second side, wherein a substrate material is disposed between adjacent patterned voids; and a ferromagnetic material disposed in the patterned voids to form vertically-oriented ferromagnetic layers.

In one or more embodiments, each vertically-oriented ferromagnetic layer has a width of about 5 nm to about 50 μm, the width determined with respect to a width axis that is parallel to a plane defined by the first side of the substrate. In one or more embodiments, each vertically-oriented ferromagnetic layer has a height of about 100 μm to about 800 μm, the height determined with respect to a height axis that is orthogonal to the plane defined by the first side of the substrate. In one or more embodiments, each vertically-oriented ferromagnetic layer has an aspect ratio in a range of about 2:1 to about 160,000:1, the aspect ratio determined by dividing the height by the width.

Another aspect of the invention is directed to an inductor comprising a vertically-laminated ferromagnetic core, comprising: a substrate having opposing first and second sides, the substrate comprising patterned voids that extend from the first side to the second side, wherein a substrate material is disposed between adjacent patterned voids; a ferromagnetic material disposed in the patterned voids to form vertically-oriented ferromagnetic layers in the vertically-laminated ferromagnetic core; and a conductive coil disposed around the vertically-laminated ferromagnetic core.

In one or more embodiments, the inductor further comprises first and second insulated material layers disposed on the first and second sides of the substrate, respectively. In one or more embodiments, the inductor further comprises first and second metal wire segments formed in the first and second insulated material layers, respectively. In one or more embodiments, the inductor further comprises first and second VIAs formed in the substrate, the vertically-oriented ferromagnetic layers disposed between the first and second VIAs. In one or more embodiments, the first and second VIAs are each electrically coupled to the first and second metal wire segments to form the conductive coil. In one or more embodiments, the first and second insulated material layers comprise first and second passivation layers, respectively. In one or more embodiments, the substrate is a core substrate and the first and second insulated material layers comprise first and second substrates, respectively.

BRIEF DESCRIPTION OF THE DRAWINGS

For a fuller understanding of the nature and advantages of the present concepts, reference is made to the following detailed description of preferred embodiments and in connection with the accompanying drawings.

DETAILED DESCRIPTION

A vertically-laminated magnetic core is formed in a semiconductor substrate. A conductive seed layer is deposited on a first side of the substrate, and a masking layer is deposited on a second side of the substrate. The first and second sides of the substrate are on opposite sides of the substrate. Next, a first pattern of holes or voids is formed in the masking layer. The patterned masking layer is then used to form a second pattern of holes or voids in the underlying substrate, the second pattern matching or corresponding to the first pattern. The holes or voids in the second pattern extend from the second side to the first side of the substrate to expose portions of the conductive seed layer according to the second pattern. A ferromagnetic material is then electrodeposited onto the exposed portions of the conductive seed layer to form vertically-oriented ferromagnetic layers in a core region of the substrate. The conductive seed layer and the patterned masking layer are removed so that only the substrate comprising the vertically-laminated magnetic core remains.

The vertically-laminated magnetic core can comprise a portion of a device that includes a magnetic core, such as an inductor, a power converter, a transformer, or other device. For example, an conductive coil can be wound around the vertically-laminated magnetic core. The conductive coil can be piecewise formed of metal wire segments and vertical interconnect accesses (VIAs). First and second metal wire segments can be formed in first and second passivation layers that are deposited on the first and second sides of the substrate. Alternatively, the first and second metal wire segments can be formed in first and second substrates that are attached to the first and second sides of the core substrate. First and second VIAs can be formed in the substrate, each VIA electrically coupling the first and second wire segments.

Figure 1:
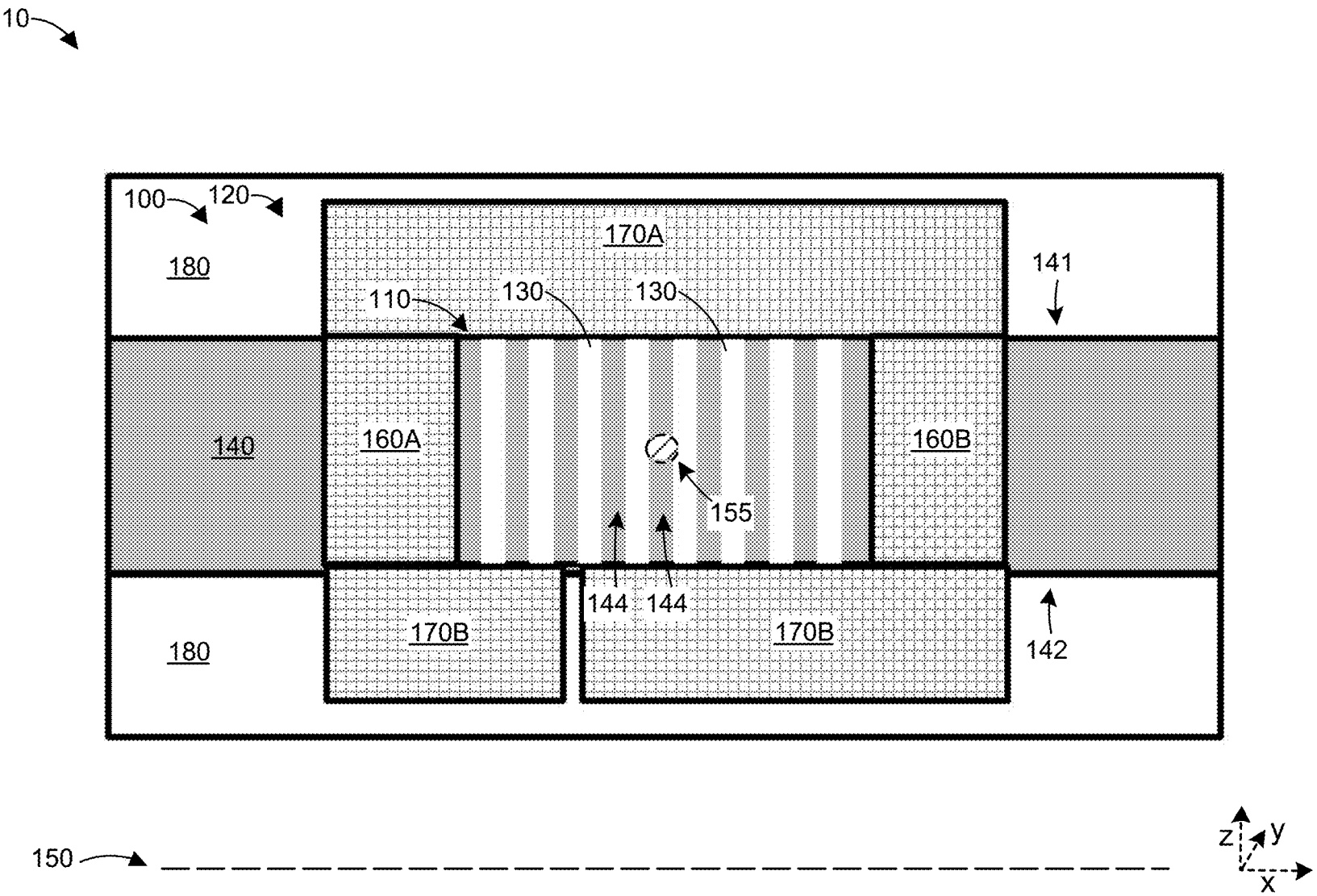
FIG. 1 is a cross-sectional view of a device comprising a thin-film magnetic inductor having a vertically-laminated magnetic core and an inductor coil according to one or more embodiments.

FIG. 1 is a cross-sectional view of a device 10 comprising a thin-film magnetic inductor 100 having a vertically-laminated magnetic core 110 and an inductor coil 120 according to one or more embodiments.

The magnetic core 110 includes a plurality of ferromagnetic layers 130 formed in a substrate 140. The ferromagnetic layers 130 are vertically-oriented with respect to opposing first and second sides 141, 142 of the substrate 140, which are each parallel or substantially parallel to each other (e.g., parallel to within about 1° or about 2° in any dimension) and to a reference plane 150. For example, the ferromagnetic layers extend in the "z" direction which is orthogonal to the "x" and "y" directions of the reference plane 150. As used herein, "about" means plus or minus 10% of the relevant value. The ferromagnetic layers 130 comprise a ferromagnetic material such as Co, Ni, and/or Fe, including $Ni_xFe_y$ or $Co_xN_yFe$. In addition, or in the alternative, the ferromagnetic layers 130 can comprise an oxide of Co, Ni, and/or Fe, such as $Co_xO_y$, $Ni_xO_y$ and/or $Fe_xO_y$ respectively. In some embodiments, the ferromagnetic layers 130 can have an easy axis of magnetization and/or a hard axis of magnetization that is/are permanently or semi-permanently induced by application of an external magnetic field. The external magnetic field can be applied during deposition of the ferromagnetic material and/or during an anneal after the ferromagnetic material is deposited.

The substrate 140 comprises a semiconductor material such as silicon (Si), silicon-on-insulator (SOI), silicon carbide (SIC), a Group III-V semiconductor material (e.g., gallium nitride (GaN), gallium arsenide (GaAs), gallium phosphate (GaP), and/or another Group III-V semiconductor material), silicon germanium (SiGe), a II-VI semiconductor material (e.g., CdSe, CdTe, CdHgTe, ZnS, and/or another Group II-VI semiconductor material). The insulator in the 501 can include one or more layers of $SiO_2$ and/or $Si_xN_y$. In one example, the substrate 140 is or includes a bare Si wafer. In another example, the substrate 140 is or includes a SOI wafer. In other examples, the substrate 140 is or includes a wafer that includes one of or more of the foregoing material (s).

The ferromagnetic layers 130 are surrounded by substrate material such that each ferromagnetic layer 130 is disposed between adjacent substrate layers 144. The substrate layers 144, which extend in the z direction, are defined when the ferromagnetic layers 130 are formed in the substrate 140. The alternating ferromagnetic layers 130 and substrate layers 144 form the vertically-laminated magnetic core 110.

The inductor coil 120 is wrapped around the magnetic core 110 in a generally spiral manner along a central axis 155, which extends in the y direction through the center of the magnetic core 110. The magnetic field generated by the inductor coil 120 travels through the magnetic core 110 as it passes into or out of the page, depending on the direction of winding of the inductor coil 120 and the direction of current flow through the inductor coil 120.

The inductor coil 120 is piecewise formed out of vertical interconnect accesses (VIAs) 160A, 160B (in general, VIAs 160) and wire segments 170A, 170B (in general, wire segments 170). The wire segments 170 pertain to different metal wiring levels and the VIAs 160 interconnect the wire segments 170 on each metal wiring level. The VIAs 160 and wire segments 170 are formed out of an electrically-conductive material such as metal. For example, the metal can comprise copper, aluminum, gold, and/or another metal, or an alloy or compound of any of the foregoing metals.

The VIAs 160 are formed in holes through the substrate 140. Each wire segment 170 is formed in an insulated structure 180 on the corresponding side 141, 142 of the substrate 140. In one example, each structure 180 comprises a passivation layer that is deposited on the corresponding side 141, 142 of the substrate 140. Alternatively, each structure 180 can comprise a corresponding other substrate that can be attached to the corresponding side 141, 142 of the substrate 140. In another embodiment, one of structures 180 comprises a passivation layer and the other structure 180 comprises another substrate.

Figure 2:
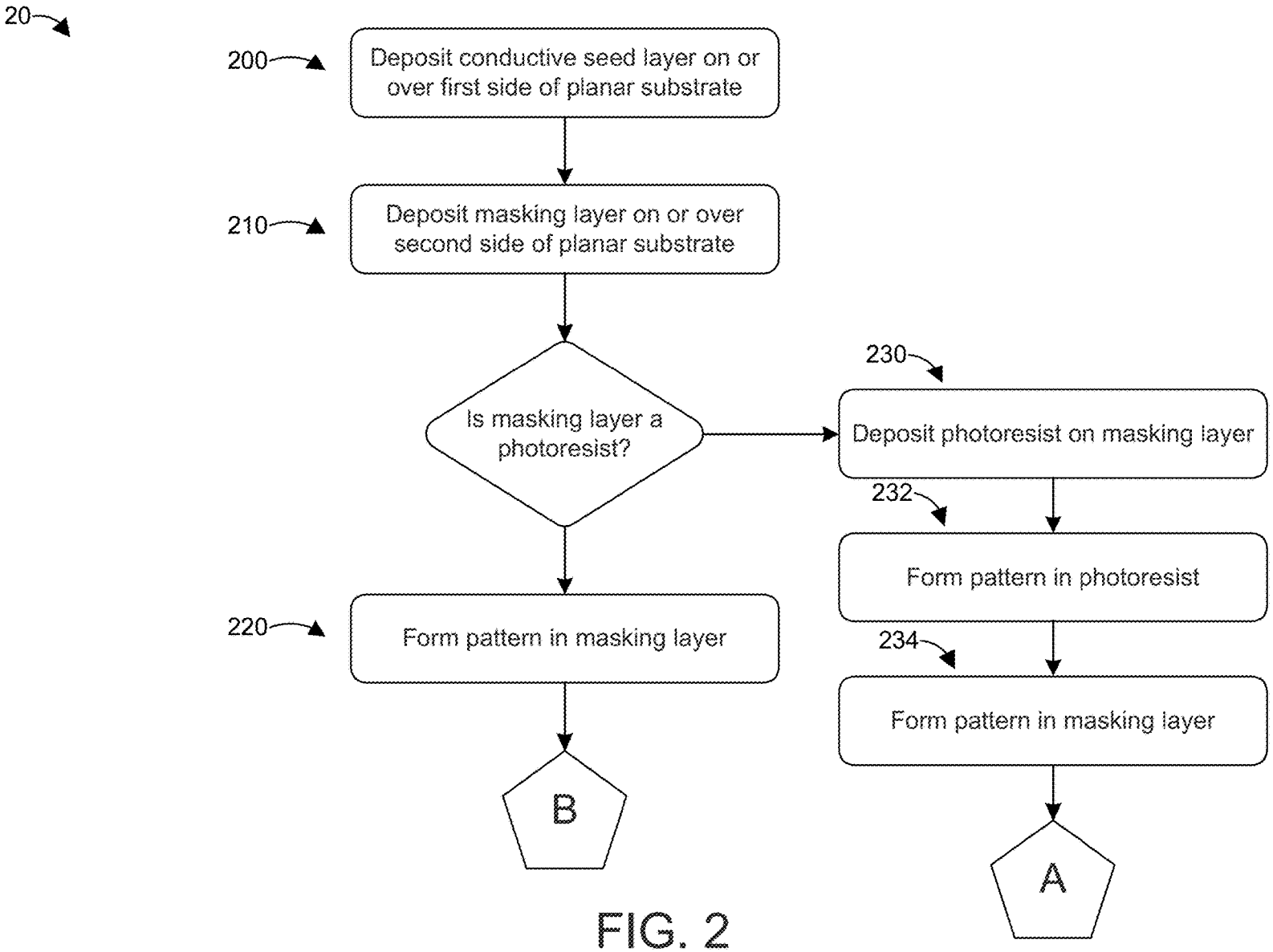
FIG. 2 is a flow chart of a method for manufacturing an inductor comprising a vertically-oriented laminated ferromagnetic core according to one or more embodiments.
Figure 2:
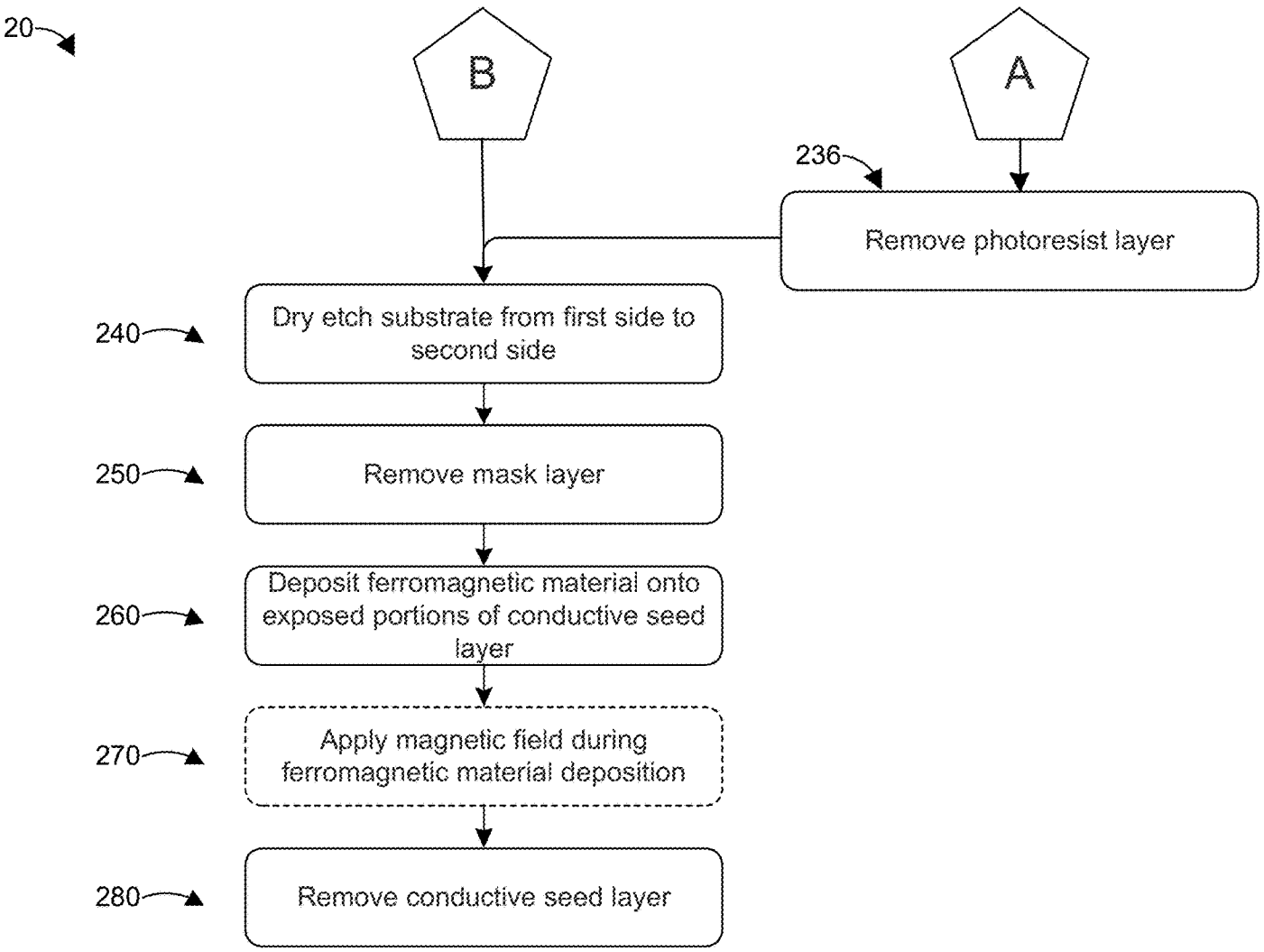

FIG. 2 is a flow chart 20 of a method for manufacturing an inductor comprising a vertically-oriented laminated ferromagnetic core according to one or more embodiments. The method of flow chart 20 can be used to manufacture the device 10.

In step 200, a conductive seed layer is deposited on or over a first side of a planar substrate. The conductive seed layer can comprise a metal, such as copper, aluminum, gold, silver, tin, nickel, and/or another metal, or an alloy or compound of any of the foregoing metals. The planar substrate can be the same as substrate 140, and the first side of the planar substrate can correspond to the first side 141 of the substrate 140. In other embodiments, the first side of the planar substrate can correspond to the second side 142 of the substrate 140.

Figure 3A:
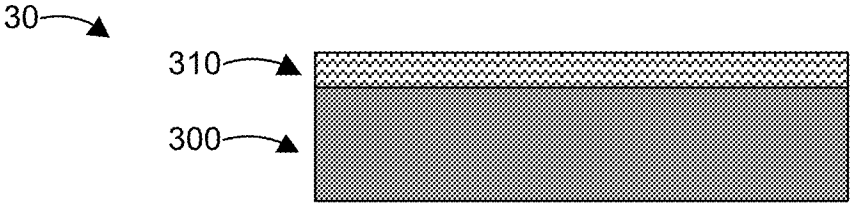
FIGS. 3A and 3B illustrate a cross-sectional view and a top view, respectively, of a structure 30 formed in a first step of the flow chart of FIG. 2.
Figure 3B:
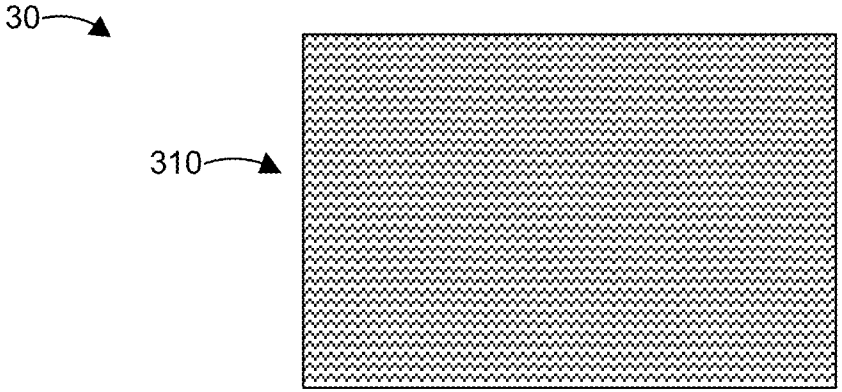

FIGS. 3A and 3B illustrate a cross-sectional view and a top view, respectively, of the structure 30 formed in step 200. Structure 30 includes a conductive seed layer 310 disposed on a first side of the substrate 300. As discussed above, in some embodiments the conductive seed layer 310 is disposed on a planar surface, such as an exposed portion of a multilevel wiring structure, that itself is disposed on the first side of the substrate 300. Thus, the conductive seed layer 310 can be deposited directly or indirectly on the first side of the substrate 300.

In step 210, a masking layer is deposited on or over a second side of the planar substrate. The first and second sides are on opposite sides of the planar substrate. The second side of the planar substrate can correspond to the second side 142 of the substrate 140. In other embodiments, the second side of the planar substrate can correspond to the second side 142 of the substrate 140. The masking layer can comprise a photo-imageable polymer (e.g., photoresist) layer or a Si-based material such as $SiO_2$ or $Si_xN_y$. An example of a photoresist is the MICROPOSIT® S1800™ series, available from MicroChem Corp. The photoresist can be deposited by a spin-on process. The Si-based material, such as $SiO_2$ or $Si_xN_y$, can be thermally grown or deposited on the substrate by chemical vapor deposition (CVD), plasma-enhanced CVD, or other deposition method.

Figure 4A:
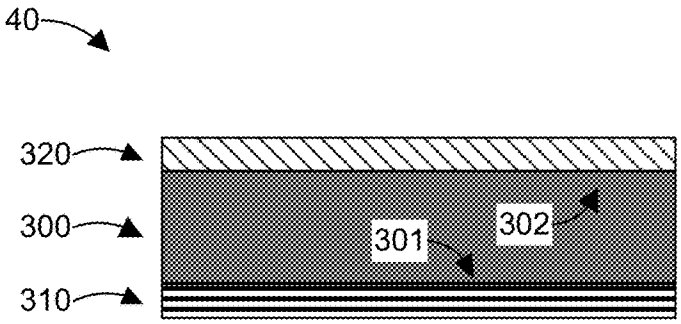
FIGS. 4A and 4B illustrate a cross-sectional view and a top view, respectively, of a structure formed in another step of the flow chart of FIG. 2.
Figure 4B:
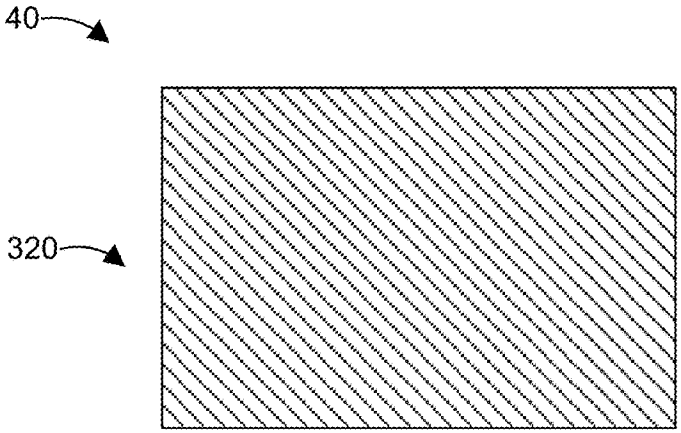

FIGS. 4A and 4B illustrate a cross-sectional view and a top view, respectively, of the structure 40 formed in step 210. Structure 40 includes the conductive seed layer 310 deposited on a first side 301 of the substrate 300 and a masking layer 320 deposited on a second side 302 of the substrate 300. The substrate 300 illustrated in FIGS. 4A and 4B is rotated 180° with respect to the substrate 300 illustrated in FIGS. 3A and 3B so that the masking layer 320 can be deposited on the second side 302 of the substrate 300. As discussed above, in some embodiments the masking layer 320 is disposed on a planar surface, such as an exposed portion of a multilevel wiring structure, that itself is disposed on the second side 302 of the substrate 300. Thus, the masking layer 320 can be deposited directly or indirectly on the second side 302 of the substrate 300.

In step 220, a pattern is formed in the masking layer. When the masking layer is a photoresist, step 220 includes photolithography and removal of the exposed or unexposed photoresist (depending on whether the photoresist is positive or negative) to form a patterned photoresist layer.

Figure 5A:
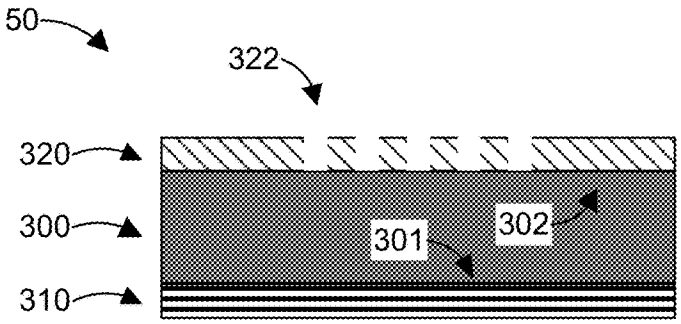
FIGS. 5A and 5B illustrate a cross-sectional view and a top view, respectively, of a structure formed in yet another step of the flow chart of FIG. 2.
Figure 5B:
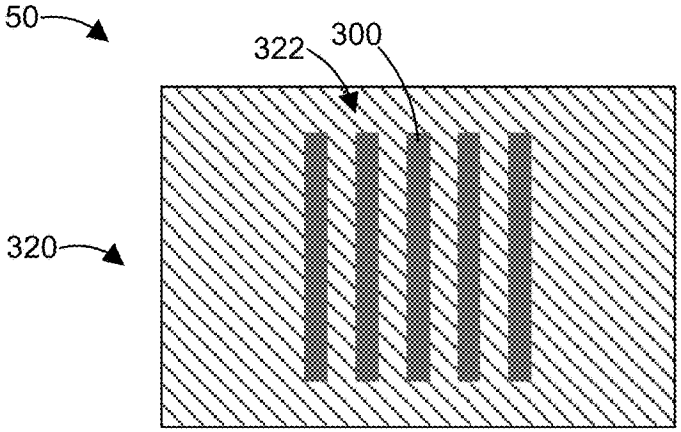

FIGS. 5A and 5B illustrate a cross-sectional view and a top view, respectively, of the structure 50 formed in step 220.

Structure 50 is the same as structure 40 except that in structure 50 the masking layer 320 is patterned to define voids 322. The voids 322 expose the underlying substrate 300, as illustrated in FIG. 5B.

When the masking layer does not include photoresist (e.g., the masking layer includes a Si-based material), the flow chart proceeds from step 210 to step 230 where photoresist is deposited on the masking layer. In step 232, a pattern is formed in the photoresist layer. Step 232 can be the same as, substantially the same as, or different than step 220. In step 234, a pattern is formed in the masking layer. The pattern in the masking layer can be formed by a wet or dry etch process using the pattern in the photoresist. In step 236 (via placeholder A), the photoresist is removed (e.g., using a solvent or a plasma).

Figure 6A:
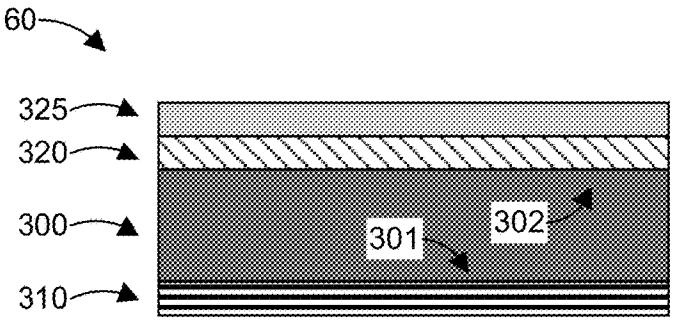
FIGS. 6A and 6B illustrate a cross-sectional view and a top view, respectively, of a structure formed in another step of the flow chart of FIG. 2.
Figure 6B:
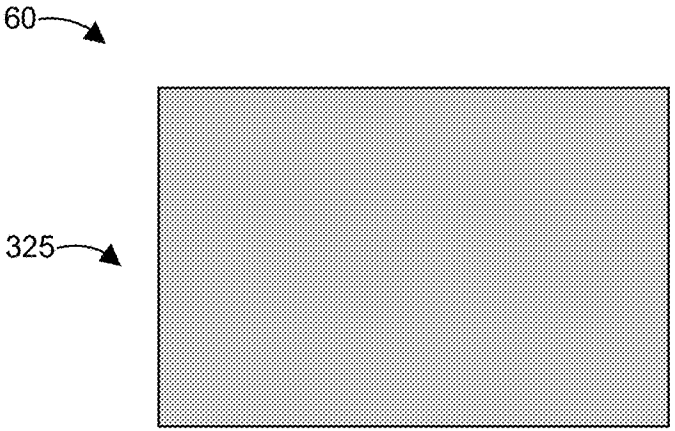

FIGS. 6A and 6B illustrate a cross-sectional view and a top view, respectively, of the structure 60 formed in step 230. Structure 60 is the same as structure 40 except that in structure 60 a photoresist layer 325 is deposited on the masking layer 320. The photoresist layer 325 can be used to define features in the masking layer 320 when the masking layer 320 does not comprise a photoresist (e.g., the masking layer 320 includes a Si-based material).

Figure 7A:
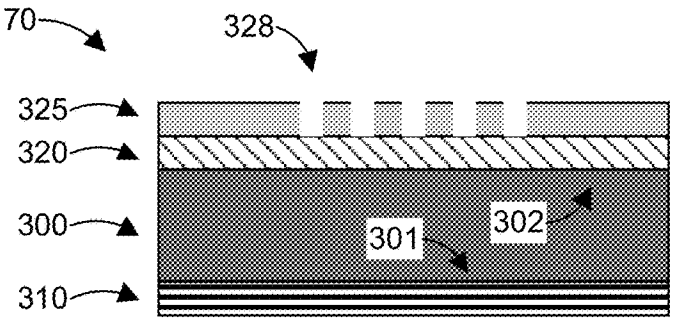
FIGS. 7A and 7B illustrate a cross-sectional view and a top view, respectively, of a structure formed in yet another step of the flow chart of FIG. 2.
Figure 7B:
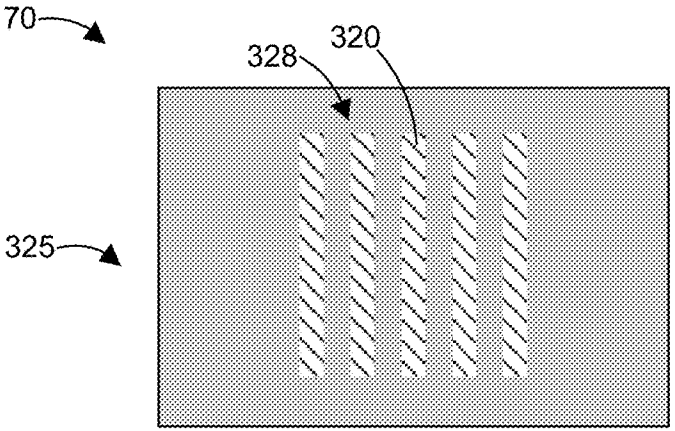

FIGS. 7A and 7B illustrate a cross-sectional view and a top view, respectively, of the structure 70 formed in step 232. Structure 70 is the same as structure 60 except that in structure 70 the photoresist layer 325 is patterned to define voids 328. The voids 328 expose the underlying masking layer 320, as illustrated in FIG. 7B.

Figure 8A:
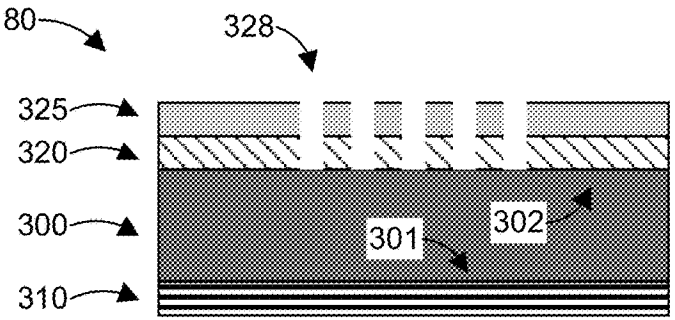
FIGS. 8A and 8B illustrate a cross-sectional view and a top view, respectively, of a structure formed in another step of the flow chart of FIG. 2.
Figure 8B:
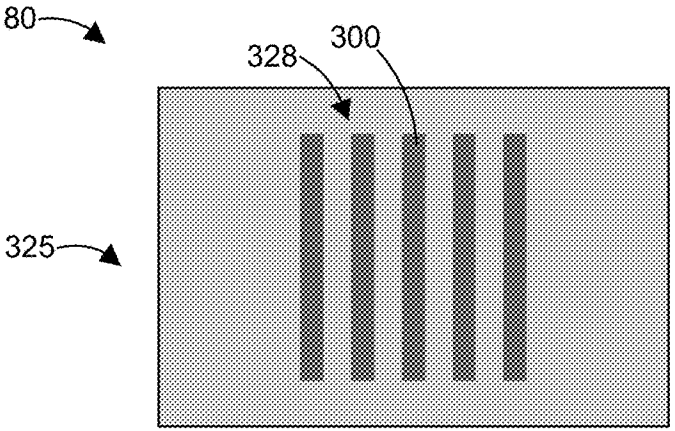

FIGS. 8A and 8B illustrate a cross-sectional view and a top view, respectively, of the structure 80 formed in step 234. Structure 80 is the same as structure 70 except that in structure 80 the masking layer 320 is etched so that the voids 328 extend through masking layer 320 to expose the underlying substrate 300, as illustrated in FIG. 8B.

FIGS. 8A and 8B illustrate a cross-sectional view and a top view, respectively, of the structure 80 formed in step 234. Structure 80 is the same as structure 70 except that in structure 80 the masking layer 320 is etched so that the voids 328 extend through masking layer 320 to expose the underlying substrate 300, as illustrated in FIG. 8B.

Figure 9A:
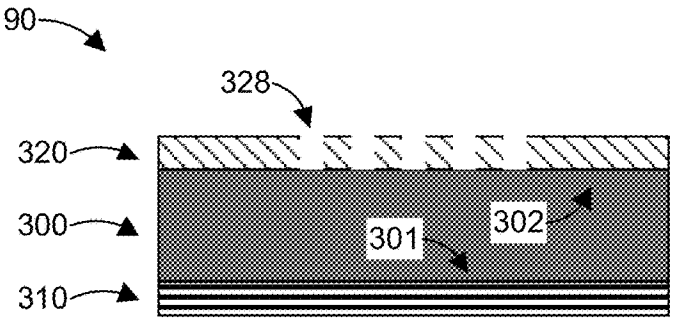
FIGS. 9A and 9B illustrate a cross-sectional view and a top view, respectively, of a structure formed in yet another step of the flow chart of FIG. 2.
Figure 9B:
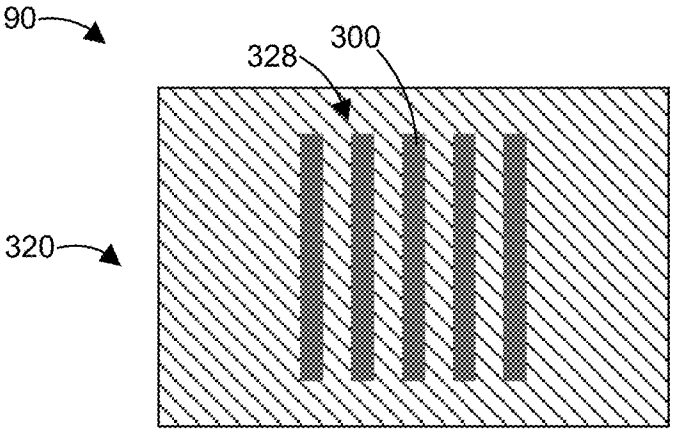

FIGS. 9A and 9B illustrate a cross-sectional view and a top view, respectively, of the structure 90 formed in step 236. Structure 90 is the same as structure 80 except that in structure 90 the photoresist layer 325 is removed. In addition, structure 90 is the same as structure 50 except that in structure 90 the masking layer 320 is a Si-based material while in structure 50 the masking layer 320 is a photoresist.

After the masking layer is patterned or etched in step 220 or 234, the flow chart 20 proceeds to step 240 (via placeholder A). In step 240, the substrate is dry etched, based on the pattern formed in the masking layer, from its first side to its second side to expose portions of the conductive seed layer. The etching can be performed with a dry etching process, such as deep reactive-ion etching (DRIE), to create vertical voids or holes through the substrate. In some embodiments, the voids or holes can have an aspect ratio of 2:1 up to 160,000:1 (feature height to feature width). A wet etching process can be used to achieve an aspect ratio less than 5:1.

Figure 10A:
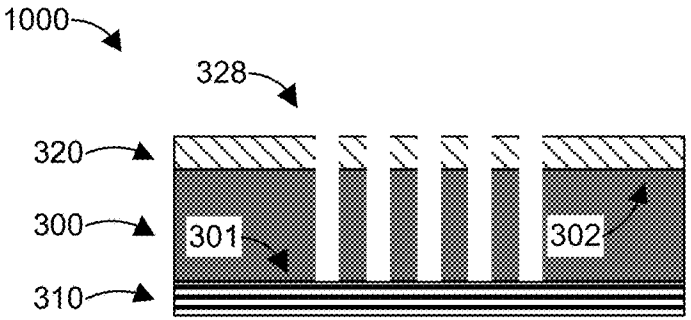
FIGS. 10A and 10B illustrate a cross-sectional view and a top view, respectively, of a structure formed in another step of the flow chart of FIG. 2.
Figure 10B:
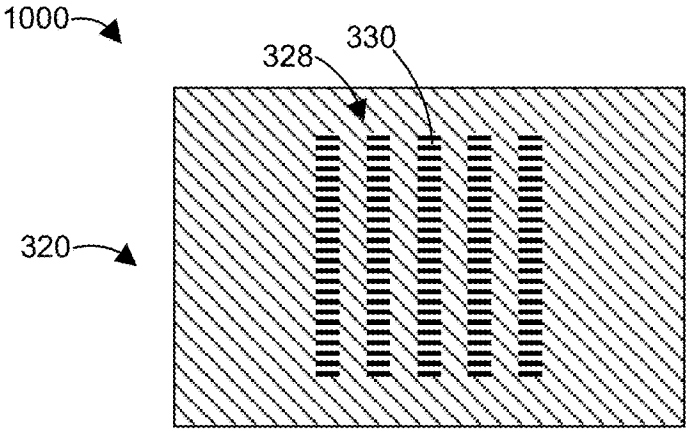

FIGS. 10A and 10B illustrate a cross-sectional view and a top view, respectively, of the structure 1000 formed in step 240. Structure 1000 is the same as structures 50 and 90 except that in structure 1000 the voids 328 or holes extend through the masking layer 320 and through the substrate 300 from the second side 302 to the first side 301 to expose portions of conductive seed layer 310.

In step 250, the masking layer 320 is removed or stripped. The masking layer can be stripped before or after electroplating without effecting the process or final device fabrication. When the masking layer 320 comprises a photoresist, the masking layer 320 can be removed using a solvent, a wet etch, and/or a dry etch. When the masking layer 320 comprises a Si-based material, the masking layer 320 can be removed with a wet or dry etch.

Figure 11A:
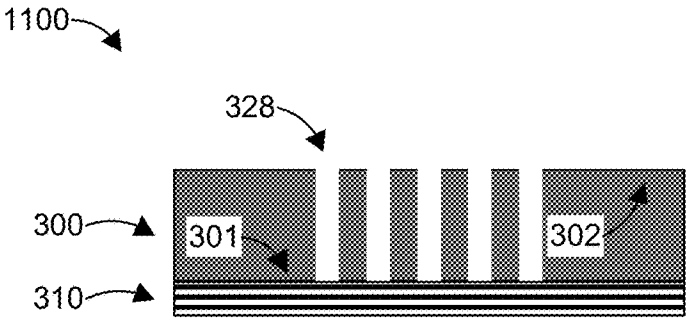
FIGS. 11A and 11B illustrate a cross-sectional view and a top view, respectively, of a structure formed in yet another step of the flow chart of FIG. 2.
Figure 11B:
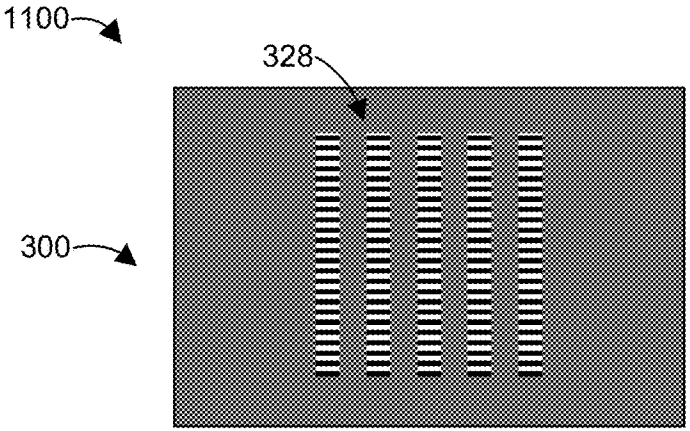

FIGS. 11A and 11B illustrate a cross-sectional view and a top view, respectively, of the structure 1200 formed in step 250. Structure 1100 is the same as structure 1000 except that the masking layer 320 has been removed.

In step 260, ferromagnetic material is deposited (e.g., via electroplating) onto the exposed portions of the conductive seed layer. The ferromagnetic material can fill the voids or holes in the planar substrate and optionally the corresponding voids or holes in the masking layer. The ferromagnetic material deposited in step 260 can comprise the same ferromagnetic material(s) as in the ferromagnetic layers 130 described above. In some embodiments, the ferromagnetic material can be deposited with a thickness range (e.g., in the "z" direction that is orthogonal to the first side 301 and the second side 302 of the substrate 300) of about 100 μm to about 800 μm.

In optional step 270, a magnetic field is applied during step 260. The magnetic field is oriented to pass through the substrate 300 in a direction that is parallel to (or substantially parallel to) the voids/holes 328 and orthogonal (or substantially orthogonal to (e.g., orthogonal within about 1° to about 5°)) to the planes defined by the first and second sides 301, 302 of the substrate 300. The magnetic field induces an easy axis of magnetization in the deposited ferromagnetic material that is parallel to (or substantially parallel to) the magnetic field. Inducement of an easy axis of magnetization further induces a hard axis of magnetization in the deposited ferromagnetic material in a direction that is orthogonal to (or substantially orthogonal to) the easy axis of magnetization.

Figure 12A:
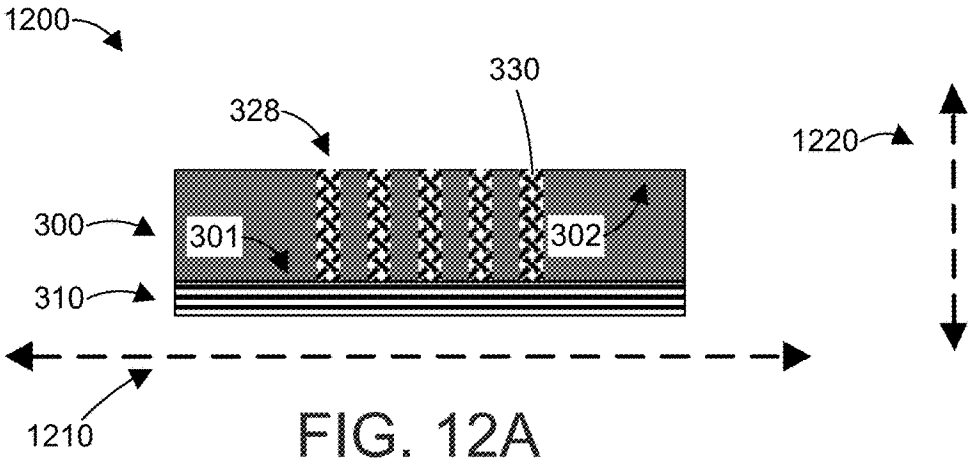
FIGS. 12A and 12B illustrate a cross-sectional view and a top view, respectively, of a structure formed in another step of the flow chart of FIG. 2.
Figure 12B:
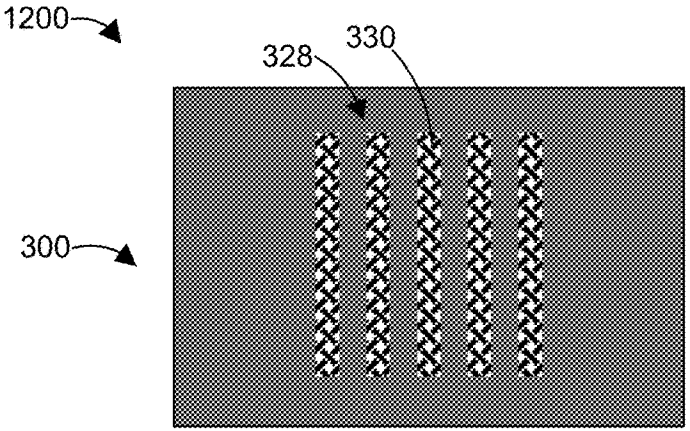

FIGS. 12A and 12B illustrate a cross-sectional view and a top view, respectively, of the structure 1100 formed in step 260. Structure 1200 is the same as structure 1100 except that in structure 1200 the voids 328 or holes are filled with ferromagnetic material to form vertically-oriented ferromagnetic layers 330. The vertically-oriented ferromagnetic layers 330 can have a width, measured with respect to horizontal axis 1210 that extends parallel to the vertically-oriented ferromagnetic layer 300 and to the substrate material laminations, of about 5 nm to about 50 μm, including about 500 nm, about 1,000 nm, about 2,500 nm, about 5,000 nm, about 10,000 nm, about 15,000 nm, about 20,000 nm, about 25,000 nm, about 30,000 nm, about 35,000 nm, about 40,000 nm, about 45,000 nm including any range or width between any two of the foregoing widths. The vertically-oriented ferromagnetic layers 330 can have the same widths or different widths. The horizontal axis 1210 is also parallel to the planes defined by the first and/or second sides 301, 302 of the substrate 300. In some embodiments, vertically-oriented ferromagnetic layers 330 having a width in the range of about 5 nm to about 50 μm can generally suppress eddy currents in the frequency band of about 1 MHz to about 10 GHz depending on the electrical resistivity of the intrinsic ferromagnetic material.

In addition, the vertically-oriented ferromagnetic layers 330 can have a height, measured with respect to vertical axis 1220 (which is orthogonal to horizontal axis 1210 and to the planes defined by first and second sides 301, 302 of the substrate 300), of about 100 μm to about 800 μm. The height of the vertically-oriented ferromagnetic layers 330 is the same as or about the same as the height of the substrate 300. Thus, the vertically-oriented ferromagnetic layers 330 can have an aspect ratio (height:width) range of about 2:1 to about 160,000:1.

In step 280, the conductive seed layer 310 is removed to expose the first side 301 of the substrate 300. The conductive seed layer 310 can be removed using a wet etch or dry etch.

Figure 13A:
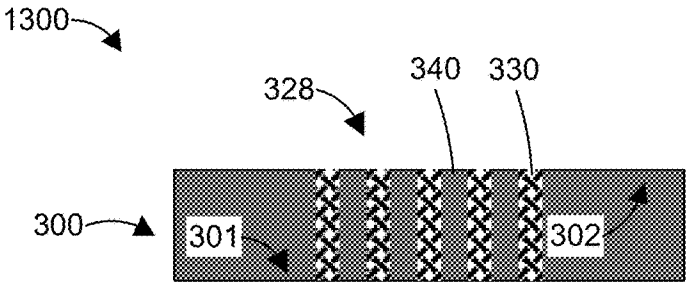
FIGS. 13A and 13B illustrate a cross-sectional view and a top view, respectively, of a structure formed in yet another step of the flow chart of FIG. 2.
Figure 13B:
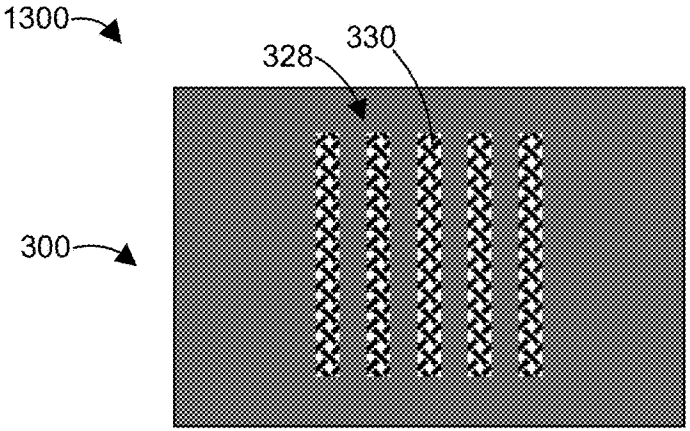

FIGS. 13A and 13B illustrate a cross-sectional view and a top view, respectively, of the structure 1300 formed in step 280. Structure 1300 is the same as structure 1200 except that the conductive seed layer 310 has been removed. Structure 1300 comprises vertically-oriented ferromagnetic layers 330 that are surrounded by substrate material to form a vertically-laminated structure having alternating vertically-oriented ferromagnetic layers 330 and substrate layers 340. The vertically-laminated structure can function as a vertically-laminated magnetic core for an inductor, transformer, or other electrical component that includes a magnetic core.

Figure 14:
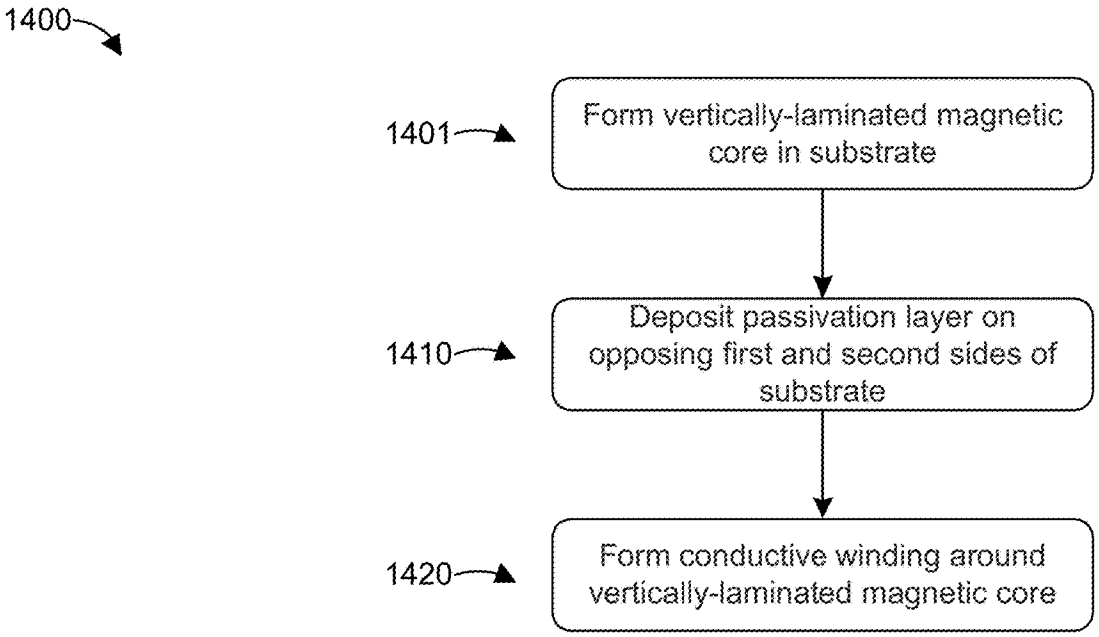
FIG. 14 is a flow chart of a method for manufacturing a device that includes a vertically-laminated magnetic core according to one or more embodiments.

FIG. 14 is a flow chart 1400 of a method for manufacturing a device that includes a vertically-laminated magnetic core according to one or more embodiments. In step 1401, a vertically-laminated magnetic core (e.g., structure 1300) is formed. The vertically-laminated magnetic core can be formed using some or all of the steps in flow chart 20. In step 1410, a passivation layer is deposited on opposing first and second sides of the vertically-laminated magnetic core (e.g., on opposing first and second sides 301, 302 of the substrate 300). The passivation layer can comprise $SiO_2$, $Si_xN_y$, and/or another material. The passivation layer, such as $SiO_2$ or $Si_xN_y$, can be thermally grown or deposited by chemical vapor deposition (CVD), plasma-enhanced CVD, or other deposition method. The passivation can have a thickness range of about 100 nm to about 1 μm.

In step 1420, a conductive winding is formed around the vertically-laminated core. The conductive winding can be fabricated using known semiconductor processes, such as physical vapor deposition and electrodeposition of conductive materials to form the wiring levels and VIAs. Some portions of the conductive winding can be formed prior to step 1410. For example, the VIAs can be formed in the substrate before the passivation layer is deposited in step 1410.

In some embodiments, the conductive winding is formed in a portion of a multilevel wiring structure. For example, one or both of the wiring levels can comprise a portion of a multilevel wiring structure. An example of a conductive winding formed in a multilevel wiring structure is described in U.S. patent application Ser. No. 13/609,391, titled "Magnetic Core Inductor Integrated with Multilevel Wiring Network," filed on Sep. 11, 2012, which is hereby incorporated by reference.

The device formed as a result of flow chart 1400 can be the same as or different than device 10.

Figure 15:
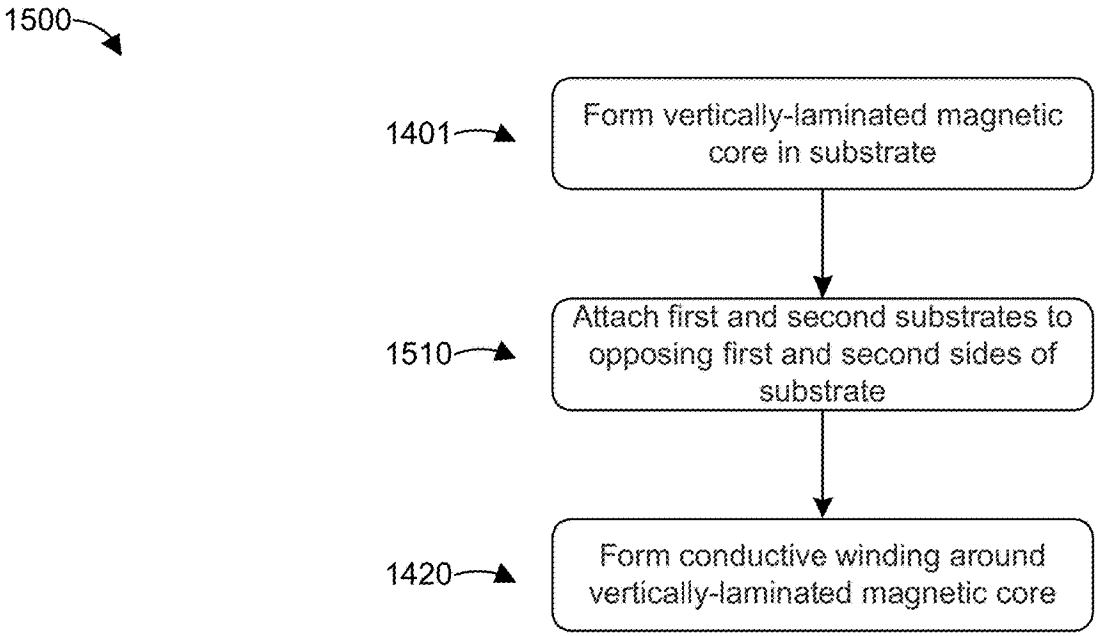
FIG. 15 is a flow chart of a method for manufacturing a device that includes a vertically-laminated magnetic core according to one or more alternative embodiments.

FIG. 15 is a flow chart 1500 of a method for manufacturing a device that includes a vertically-laminated magnetic core according to one or more alternative embodiments. Flow chart 1500 is the same as flow chart 1400 except that in flow chart 1500 first and second substrates are attached to opposing first and second sides of the substrate (e.g., to first and second sides 301, 302 of the substrate 300), respectively, in step 1510. Each substrate can be the same as or different than substrate 140, 300. Thus, substrates can be used instead of passivation layers to form the wiring segments for the conductive winding formed in step 1420.

Figure 16A:
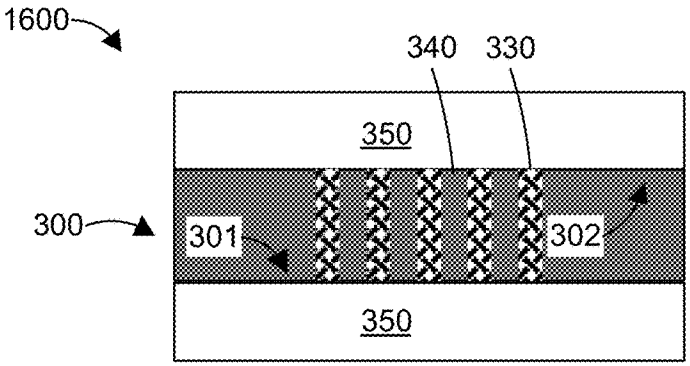
FIGS. 16A and 16B illustrate a cross-sectional view and a top view, respectively, of a structure formed in a step of the flow chart illustrated in FIG. 14 or FIG. 15.
Figure 16B:
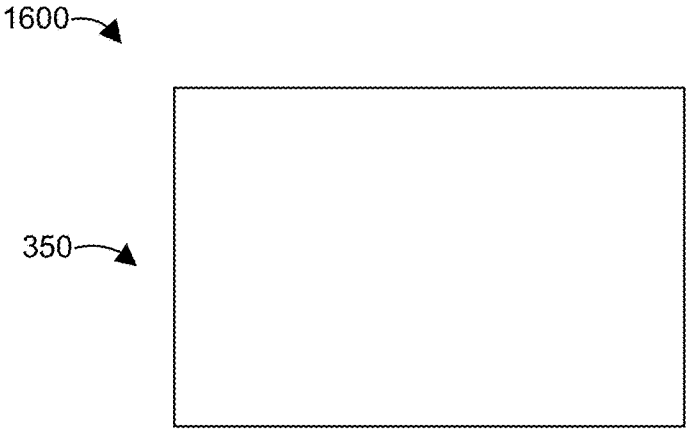

FIGS. 16A and 16B illustrate a cross-sectional view and a top view, respectively, of the structure 1600 formed in step 1410 or 1510. Structure 1600 is the same as structure 1300 except that an insulating layer 350 is deposited on the first and second sides 301, 302 of the substrate 300. The insulating layer 350 can correspond to a passivation layer deposited on substrate 300 or an additional substrate attached to substrate 300. In some embodiments, a passivation layer can be deposited on the first side 301 (or on the second side 302) of the substrate 300 and an additional substrate can be attached to the second side 302 (or to the first side 301) of the substrate 300.

Figure 17:
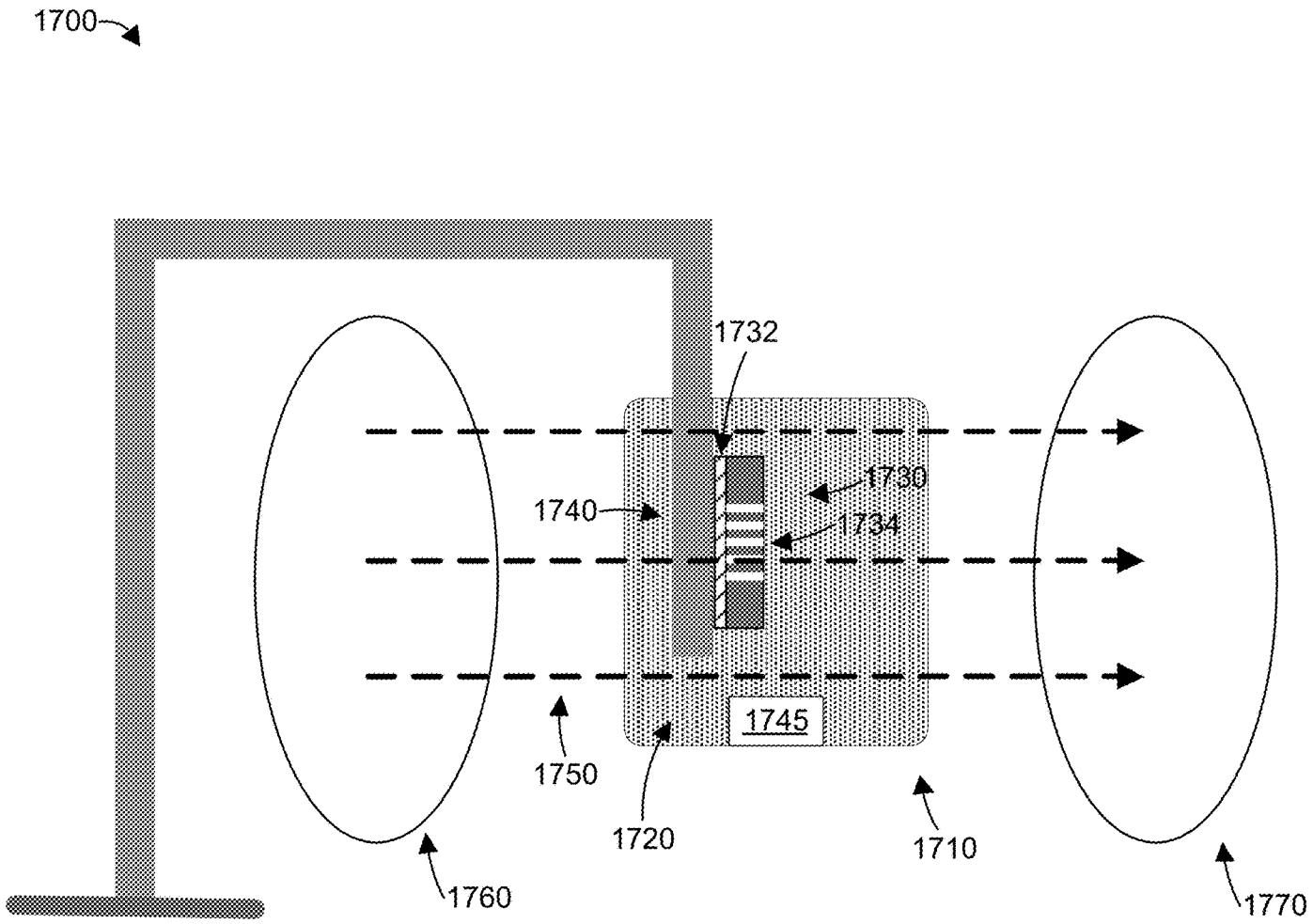
FIG. 17 is a side view of an apparatus for electrodepositing ferromagnetic material in the presence of a magnetic field according to one or more embodiments.

FIG. 17 is a side view of an apparatus 1700 for electrodepositing ferromagnetic material in the presence of a magnetic field according to one or more embodiments. The apparatus 1700 includes an electrodeposition tank 1710 that holds an electrolytic or electroplating solution 1720 that contains constituents that are precursors to a ferromagnetic material. A substrate 1730 is disposed on an electroplating cathode 1740 in the tank 1710. A conductive seed layer 1732, deposited on the substrate 1730, provides electrical contact between the cathode 1740 and the electroplating solution 1720. Before deposition begins, the substrate 1730 can be the same as or different than structure 1100.

An anode 1745 is in electrical contact with the electroplating solution 1720 in the tank 1710. During deposition, a current is applied to the anode 1745, which causes ferromagnetic material in the electroplating solution 1720 to be electrodeposited on the substrate 1730 at cathode 1740. Also during deposition, a magnetic field 1750 (as illustrated by the dashed lines) is generated by first and second magnetic coils 1760, 1770. The magnetic field 1750 is orthogonal to (or substantially orthogonal to) the major planar surfaces of substrate 1730 (e.g., orthogonal to the first and second surfaces 301, 302 of substrate 300). The magnetic field 1750 is also parallel to (or substantially parallel to) the vertical voids or holes 1734 defined in the substrate 1730.

The magnetic coils 1760, 1770 can be electromagnets such as Helmholtz coils powered by a DC power supply. Such Helmholtz coils can produce a uniform or substantially uniform magnetic field transverse to the plane defining a surface of substrate 1730. The magnetic field generated by the Helmholtz coils can be about 10 Oe to about 100 Oe, about 25 Oe, about 50 Oe, about 75 Oe, or any value or range between any two of the foregoing values. Alternatively, magnetic coils 1760, 1770 can be permanent magnets that can generate a magnetic field of about 20 Oe to about 10, 000 Oe, about 2,500 Oe, about 5,000 Oe, about 7,500 Oe, or any value or range between any two of the foregoing values. The magnetic field 1750 generated by the magnetic coils 1760, 1770 induces an easy axis of magnetization in the electrodeposited ferromagnetic material that is parallel to (or substantially parallel to) the magnetic field lines 1750. Inducement of the easy axis of magnetization further induces a hard axis of magnetization in a direction that is substantially orthogonal to the direction of the easy axis of magnetization.

The substrate 1730 can be the same as structure 1100 prior to electroplating using apparatus 1700, and the substrate 1730 can be the same as structure 1200 after electroplating using apparatus 1700.

Figure 18:
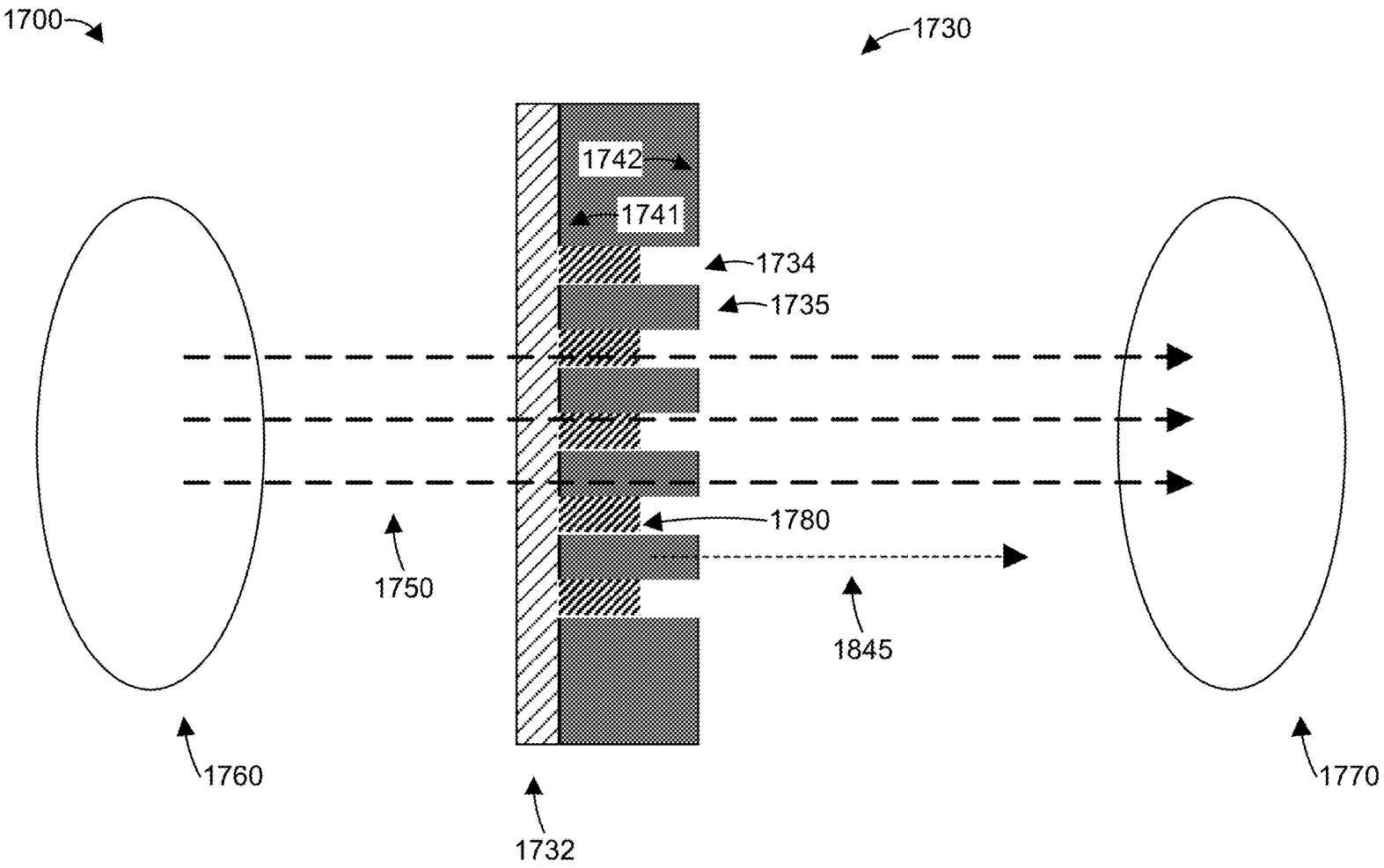
FIG. 18 is a detailed view of the orientation of the magnetic field with respect to the substrate and patterned voids or holes illustrated in FIG. 17.

FIG. 18 is a detailed view of the orientation of the magnetic field 1750 with respect to the substrate 1730 and the patterned voids or holes 1734. As illustrated, the magnetic field lines 1750 are orthogonal to (or substantially orthogonal to) the first and second sides 1741, 1742 of the substrate 1730. The magnetic field lines 1750 are also parallel to (or substantially parallel to) the vertical columns or mesas 1735 of substrate material, which extend from the conductive seed layer 1732 along a reference axis 1845 that is orthogonal to the first and second sides 1741, 1742 of the substrate 1730. In addition, the magnetic field lines 1950 are parallel to (or substantially parallel to) the length of the voids or holes 1734 and to the direction of deposition of ferromagnetic material 1780 as it forms vertically-oriented ferromagnetic layers.

Figure 19:
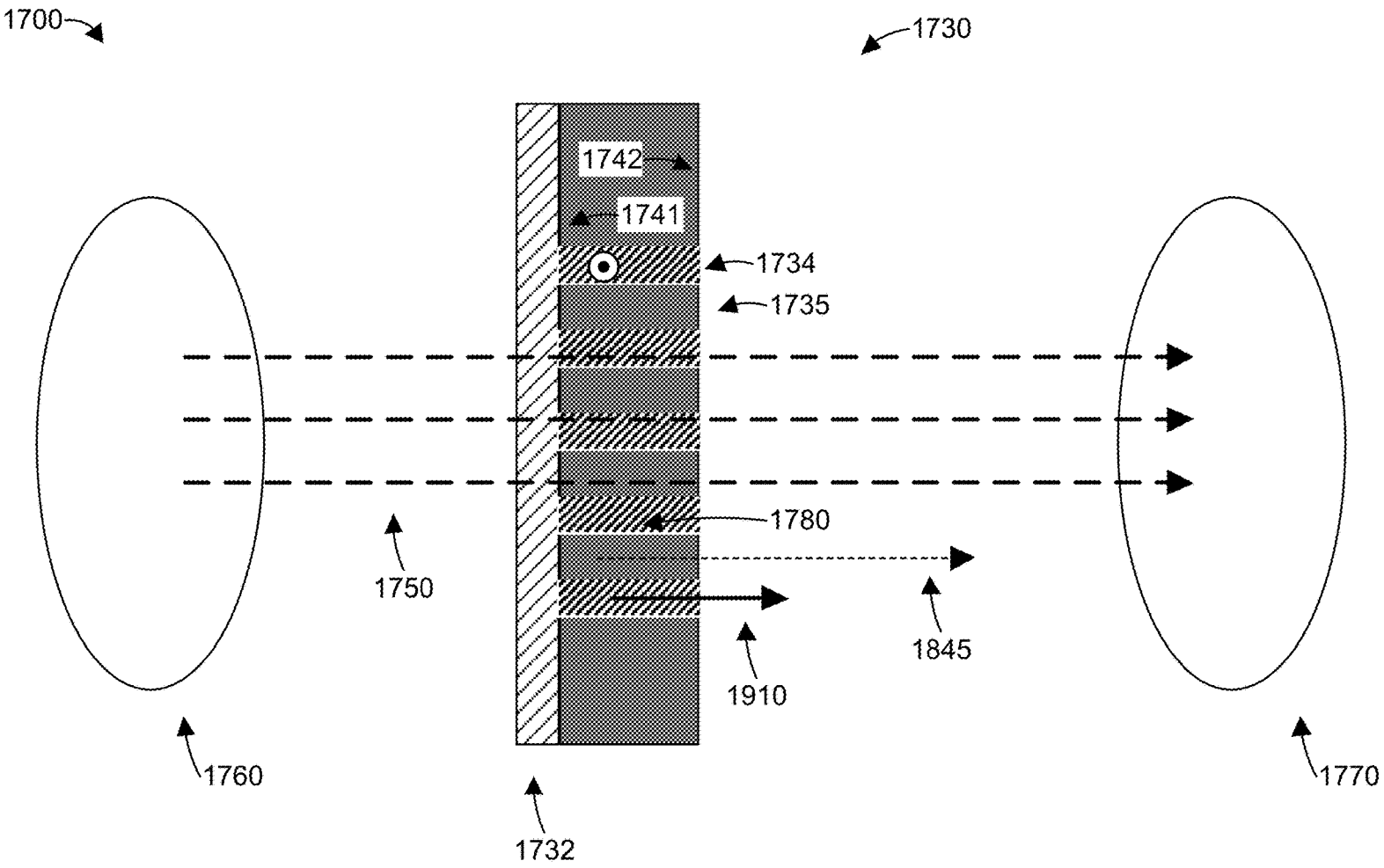
FIG. 19 is a detailed view of the orientation of the easy and hard axes of magnetization induced in the ferromagnetic material during electrodeposition according to one or more embodiments.
Figure 20A:
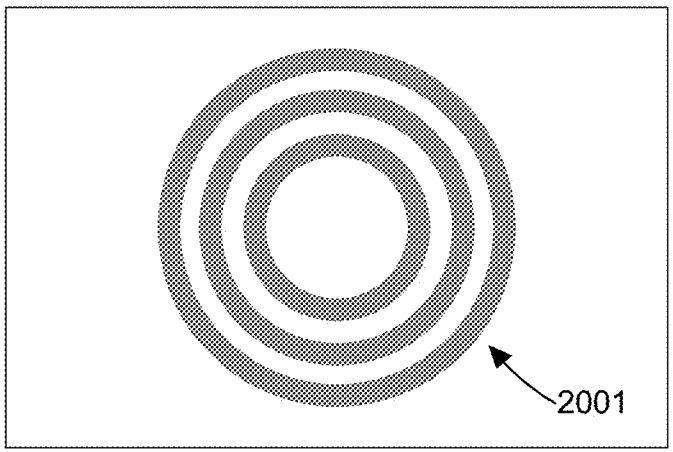
FIGS. 20A, 20B, 20C, and 20D are top views of various patterns of electrodeposited vertically-laminated ferromagnetic material according to one or more embodiments.
Figure 20B:
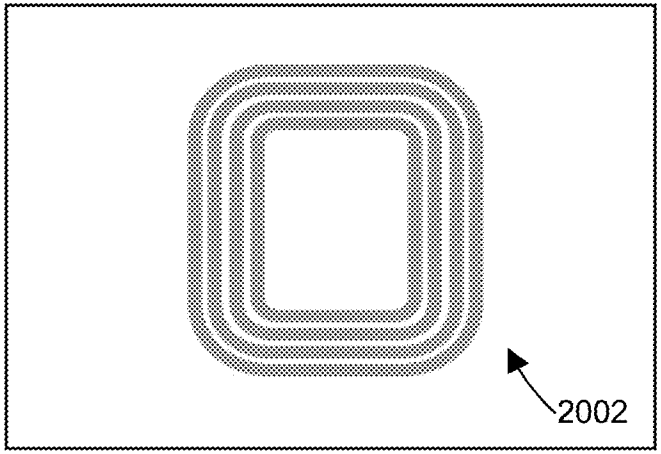
Figure 20C:
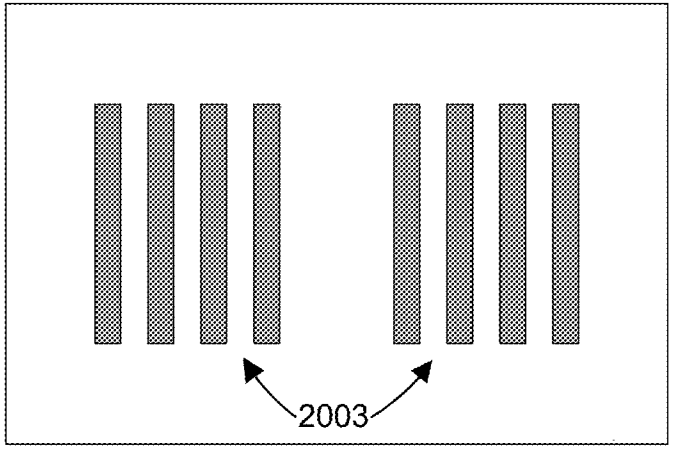
Figure 20D:
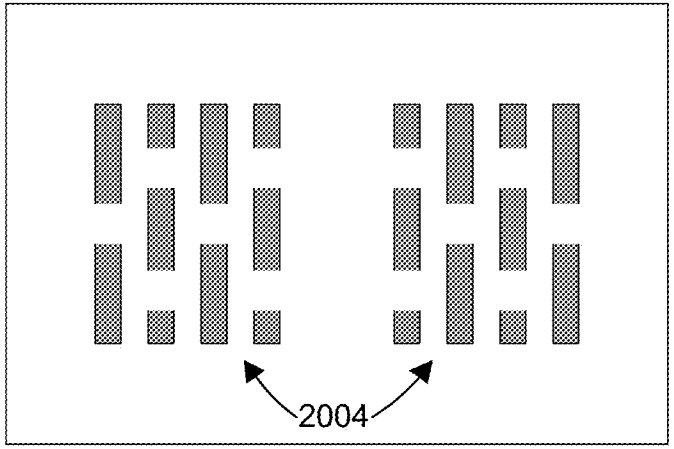

FIG. 19 is a detailed view of the orientation of the easy and hard axes of magnetization induced in the ferromagnetic material during electrodeposition according to one or more embodiments. As illustrated, the magnetic field 1750 induces an easy axis of magnetization 1910 in the electrodeposited ferromagnetic material 1780 that aligns with and is parallel to (or substantially parallel to) the magnetic field 1750 that passes therethrough. Aligning the easy axis of magnetization 1910 with the magnetic field 1750 induces a hard axis of magnetization 17920 in the electrodeposited ferromagnetic material 1780 in a direction orthogonal to (or substantially orthogonal to) the easy axis of magnetization 1910 (e.g., out of the page in FIG. 19).

It is noted that although the columns/mesas 1735 of substrate material are illustrated as horizontal in FIGS. 17-19, other orientations are possible provided that the magnetic coils 1760, 1770 are configured to generate a magnetic field that is parallel to (or substantially parallel to) the columns/mesas 1735 and to the voids or holes 1734, as described above. For example, the apparatus 1700 and substrate 1730 can be rotated counterclockwise by 90 degrees such that the substrate 1730 is horizontal and the columns/mesas are vertical. Rotating the apparatus 1700 counterclockwise by 90 degrees would cause magnetic coil 1760 to be below tank 1710 and magnetic coil 1770 to be above tank 1710. The relative orientation of the magnetic field 1750, substrate 1730, columns/mesas 1735, and voids/holes 1734 would remain the same, where the magnetic field 1750 is orthogonal to (or substantially orthogonal to) the first and second sides 1741, 1742 of the substrate 1730. The magnetic field 1750 lines would also remain parallel to (or substantially parallel to) the columns/mesas 1735 of substrate material and to the voids/holes 1734.

FIGS. 20A-D are top views of various patterns 2001-2004 of electrodeposited vertically-laminated ferromagnetic material according to one or more embodiments. The patterns 2001-2004 are formed by defining a corresponding pattern in a masking layer and etching the substrate, according to the patterned masking layer, to expose portions of a conductive seed layer. The ferromagnetic material is then electrodeposited on the portions of the conductive seed, as described above. Pattern 2001 includes a plurality of (e.g., three) concentric circles, where adjacent concentric circles are separated by substrate material to separate the vertical laminations. Pattern 2002 includes a plurality of (e.g., four) rectangular shapes, which can have square or rounded corners. Adjacent rectangular shapes are separated by substrate material to separate the vertical laminations. Pattern 2003 is a dual core, each core comprising strips or columns separated by substrate material to separate the vertical laminations. Pattern 2004 is a dual core, each core comprising strips or columns separated by substrate material in both in the x- and y-axis of the plane of the substrate to separate the vertical laminations and provide mechanical support between adjacent strips or columns of the substrate. The patterns 2001-2004 are examples of different patterns for vertical laminations that can be formed in the masking material. Other examples are possible.

The invention should not be considered limited to the particular embodiments described above, but rather should be understood to cover all aspects of the invention as fairly set out in the attached claims. Various modifications, equivalent processes, as well as numerous structures to which the invention may be applicable, will be apparent to those skilled in the art to which the invention is directed upon review of this disclosure. The claims are intended to cover such modifications and equivalents.

What is claimed is:

1. A method for manufacturing a vertically-laminated ferromagnetic core, comprising:

depositing a conductive seed layer on or over a first side of a substrate;

depositing a masking layer on or over a second side of the substrate, the first and second sides on opposite sides of the substrate;

forming a pattern in the masking layer;

dry etching the substrate, based on the pattern in the masking layer, from the second side to the first side to expose portions of the conductive seed layer; and depositing a ferromagnetic material onto the exposed portions of the conductive seed layer to form vertically-oriented ferromagnetic layers.

2. The method of claim 1, wherein the substrate comprises a bare silicon substrate or a silicon-on-insulator (SOI) substrate, the SOI substrate comprising a layer of $SiO_2$ and/or $Si_xN_y$ on the bare silicon substrate.

3. The method of claim 1, wherein etching the substrate includes deep reactive ion etching the substrate.

4. The method of claim 1, wherein the pattern in the masking layer comprises concentric circles, the ferromagnetic material deposited on the portions of the conductive seed layer according to the pattern.

5. The method of claim 1, wherein the masking layer comprises a photoresist.

6. The method of claim 5, wherein the pattern in the masking layer is formed through photolithography.

7. The method of claim 1, wherein each vertically-oriented ferromagnetic layer has a width of about 5 nm to about 50 μm, the width determined with respect to a width axis that is parallel to a plane defined by the first side of the substrate.

8. The method of claim 7, wherein each vertically-oriented ferromagnetic layer has a height of about 100 μm to about 800 μm, the height determined with respect to a height axis that is orthogonal to the plane defined by the first side of the substrate.

9. The method of claim 8, wherein the height of each vertically-oriented ferromagnetic layer is the same as a height of the substrate.

10. The method of claim 1, further comprising removing the masking layer with a solvent, a wet etch, or a dry etch.

11. The method of claim 10, further comprising removing the conductive seed layer with a wet etch or a dry etch.

12. The method of claim 11, further comprising depositing a passivation layer on the first and second sides of the substrate.

13. The method of claim 1, wherein the masking layer comprises $SiO_2$ or $Si_xN_y$ and the method further comprises depositing photoresist on the masking layer.

14. The method of claim 13, further comprising forming a first pattern in the photoresist through photolithography.

15. The method of claim 14, further comprising etching a second pattern in the masking layer based on the first pattern.

16. The method of claim 15, further comprising etching the substrate based on the second pattern in the masking layer.

17. The method of claim 1, further comprising electrodepositing the ferromagnetic material.

18. The method of claim 17, further comprising applying a magnetic field during the electrodepositing step, the magnetic field passing through the substrate in parallel to a reference axis, the reference axis orthogonal to a plane defined by the first side of the substrate.

19. The method of claim 18, further comprising inducing an easy axis of magnetization in the ferromagnetic material, the easy axis of magnetization parallel to the reference axis.

20. The method of claim 19, further comprising inducing a hard axis of magnetization in the ferromagnetic material, the hard axis of magnetization orthogonal to the easy axis of magnetization.

21. A method for manufacturing an inductor having a vertically-laminated ferromagnetic core, comprising:

depositing a conductive seed layer on or over a first side of a substrate;

depositing a masking layer on or over a second side of the substrate, the first and second sides on opposite sides of the substrate;

forming a pattern in the masking layer;

dry etching the substrate, based on the pattern in the masking layer, from the second side to the first side to expose portions of the conductive seed layer;

depositing a ferromagnetic material onto the exposed portions of the conductive seed layer to form vertically-oriented ferromagnetic layers to thereby form the vertically-laminated ferromagnetic core;

removing the conductive seed layer to expose the first side of the substrate;

removing the masking layer to expose the second side of the substrate; and forming a conductive coil around the vertically-laminated ferromagnetic core.

22. The method of claim 21, further comprising after removing the conductive seed layer and the masking layer, depositing first and second passivation layers on the first and second sides of the substrate, respectively.

23. The method of claim 22, further comprising forming first and second wire segments in the first and second passivation layers, respectively.

24. The method of claim 23, further comprising forming first and second VIAs in the substrate, each VIA electrically coupling the first and second wire segments.

25. The method of claim 21, wherein the substrate is a core substrate and the method further comprises after removing the conductive seed layer and the masking layer, attaching first and second substrates to the first and second sides of the core substrate, respectively.

26. The method of claim 25, further comprising forming first and second wire segments in the first and second substrates, respectively.

27. The method of claim 26, further comprising forming first and second VIAs in the core substrate, each VIA electrically coupling the first and second wire segments.

* * * * *